US009372021B2

(12) United States Patent
Kato et al.

(10) Patent No.: US 9,372,021 B2
(45) Date of Patent: Jun. 21, 2016

(54) AIR-CONDITIONING APPARATUS

(75) Inventors: Yohei Kato, Tokyo (JP); Naoki Wakuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 465 days.

(21) Appl. No.: 13/877,505

(22) PCT Filed: Nov. 4, 2010

(86) PCT No.: PCT/JP2010/006500

§ 371 (c)(1), (2), (4) Date: Apr. 3, 2013

(87) PCT Pub. No.: WO2012/059957

PCT Pub. Date: May 10, 2012

(65) Prior Publication Data

US 2013/0199224 A1 Aug. 8, 2013

(51) Int. Cl.
*F25B 49/02* (2006.01)
*F25B 13/00* (2006.01)

(52) U.S. Cl.
CPC ..... *F25B 49/02* (2013.01); *F25B 13/00* (2013.01); *F25B 2313/008* (2013.01); *F25B 2500/19* (2013.01); *F25B 2500/26* (2013.01); *F25B 2700/2106* (2013.01); *F25B 2700/2115* (2013.01)

(58) Field of Classification Search
CPC .. F25B 49/02; F25B 49/022; F25B 2313/008; F25B 2400/01; F25B 2500/26; F25B 2500/28; F25B 2700/2115
USPC ..... 62/84, 193
See application file for complete search history.

(56) References Cited

U.S. PATENT DOCUMENTS

| | | | | |
|---|---|---|---|---|
| 2009/0314017 | A1 | 12/2009 | Nishimura et al. | |
| 2010/0162742 | A1 | 7/2010 | Shimoda et al. | |
| 2011/0070100 | A1 * | 3/2011 | McSweeney et al. | F04B 35/04 417/53 |

FOREIGN PATENT DOCUMENTS

| | | | |
|---|---|---|---|
| JP | 61-276663 | A | 12/1986 |
| JP | 62-094772 | A | 5/1987 |
| JP | 01-300149 | A | 12/1989 |
| JP | 06-288657 | A | 10/1994 |
| JP | 07-043027 | A | 2/1995 |
| JP | 07-167504 | A | 7/1995 |
| JP | H07-310945 | A | 11/1995 |
| JP | 10-300244 | A | 11/1998 |
| JP | 2001-073952 | A | 3/2001 |

(Continued)

OTHER PUBLICATIONS

International Search Report of the International Searching Authority mailed Dec. 7, 2010 for the corresponding international application No. PCT/JP2010/006500 (with English translation).
Office Action mailed Nov. 4, 2014 issued in corresponding JP patent application No. 2012-541634 (and English translation).
Office Action dated Nov. 11, 2014 issued in corresponding AU patent application No. 2010363489.

(Continued)

*Primary Examiner* — Marc Norman
(74) *Attorney, Agent, or Firm* — Posz Law Group, PLC

(57) ABSTRACT

While a compressor is stopped, a change rate of a refrigerant temperature per predetermined time is calculated on the basis of a value detected by a refrigerant temperature sensor, and a heating amount from a compressor heating unit to the compressor is made proportional to the change rate of the refrigerant temperature.

16 Claims, 8 Drawing Sheets

(56) References Cited

FOREIGN PATENT DOCUMENTS

| | | | |
|---|---|---|---|
| JP | 2004-028503 | A | 1/2004 |
| JP | 2007-163106 | A | 6/2007 |
| JP | 4111246 | B | 7/2008 |
| WO | 2008/018381 | A1 | 2/2008 |

OTHER PUBLICATIONS

Office Action dated Sep. 5, 2014 issued in corresponding CN patent application No. 2010800699482 (and English translation).
Office Action mailed Mar. 18, 2014 issued in corresponding JP patent application No. 2012-541634 (and English translation).

* cited by examiner

AIR-CONDITIONING APPARATUS

CROSS REFERENCE TO RELATED APPLICATION

This application is a U.S. national stage application of PCT/JP2010/006500 filed on Nov. 4, 2010.

TECHNICAL FIELD

The present invention relates to an air-conditioning apparatus provided with a compressor.

BACKGROUND

In a typical air-conditioning apparatuses, there are cases in which stagnation (hereinafter also referred to as "accumulation") of a refrigerant occurs in a compressor while the apparatus is stopped.

The stagnant refrigerant in the compressor dissolves in lubricant in the compressor. This reduces the concentration of the lubricant, and thus reduces the viscosity of the lubricant.

If the compressor is started under such a condition, the lubricant having low viscosity is supplied to the rotating shaft and the compression unit of the compressor. This may result in burnout of sliding portions and the like in the compressor due to insufficient lubrication.

Furthermore, the stagnant refrigerant in the compressor raises the liquid level in the compressor. This increases the starting load of a motor for driving the compressor. The increased starting load may be identified as an overcurrent at the start-up of the air-conditioning apparatus. Thus, the air-conditioning apparatus may fail to start.

In order to solve these problems, a measure has been taken to prevent accumulation of a refrigerant in the compressor by heating the compressor while the compressor is stopped.

One method of heating the compressor is to energize an electric heater wound around the compressor. Another method is to apply a high-frequency, low-voltage current to a coil of the motor in the compressor. With this method, without rotating the motor, the compressor is heated with Joule heat generated in the coil.

However, since the compressor is heated in order to prevent stagnation of a refrigerant in the compressor while the compressor is stopped, power is consumed even while the air-conditioning apparatus is stopped.

As a countermeasure against this problem, there has been proposed a technique that "detects an outside air temperature, changes the time length or the voltage of energization from an inverter device to a motor coil in accordance with the outside air temperature, and controls the temperature of the compressor to be substantially constant regardless of changes in the outside air temperature" (see Patent Literature 1, for example.)

There has been also proposed a device that "includes saturation temperature calculating means that calculates a saturation temperature of a refrigerant in a compressor on the basis of a pressure detected by pressure detection means; and control means that compares the calculated saturation temperature with a detection temperature detected by temperature detection means, determines a state in which the refrigerant is easily condensed, and controls the heater so as to heat the compressor in the case where the compressor is stopped and the refrigerant in the compressor is in the state in which the refrigerant is easily condensed" (see Patent Literature 2, for example).

CITATION LIST

Patent Literature

Patent Literature 1: Japanese Unexamined Patent Application Publication No. 7-167504 (claim 1)

Patent Literature 2: Japanese Unexamined Patent Application Publication No. 2001-73952 (claim 1)

Technical Problem

It needs that a gas refrigerant in the compressor is condensed to stagnate refrigerant in the compressor.

In the case where the temperature of a shell covering the compressor is lower than the refrigerant temperature in the compressor, condensation of the refrigerant occurs due to a temperature difference between the compressor shell and the refrigerant, for example.

On the other hand, in the case where the temperature of the compressor shell is higher than the refrigerant temperature, no condensation occurs, and therefore there is no need to heat the compressor.

However, as disclosed in Patent Literature 1, even though only the outside air temperature that represents the refrigerant temperature is considered, if the temperature of the compressor shell is higher than the refrigerant temperature (outside air temperature), the refrigerant does not condense. That is, even when the refrigerant does not stagnate in the compressor, the compressor is heated. This results in wasteful power consumption.

Further, as mentioned above, if the refrigerant stagnates in the compressor, the concentration and viscosity of the lubricant decrease. This may result in burnout of sliding portions, such as the rotating shaft and the compression unit, due to insufficient lubrication.

It needs that the concentration of the lubricant is reduced to a predetermined value to occur such a burnout of the rotating shaft and compression unit of the compressor.

That is, when the amount of the stagnant refrigerant is equal to or lower than a predetermined value, the concentration of the lubricant is not reduced to a level that causes burnout in the compressor.

However, as disclosed in Patent Literature 2, in the case where liquefaction of the refrigerant is determined from the refrigerant saturation temperature calculated on the basis of the discharge temperature and the discharge pressure, the compressor is heated even when the concentration of the lubricant is high. This disadvantageously results in wasteful power consumption.

SUMMARY

The present invention has been made to overcome the above problems, and its objective is to provide an air-conditioning apparatus that is capable of preventing an excessive heating amount from being supplied to a compressor, and is capable of reducing power consumption while the air-conditioning apparatus is stopped.

Solution to Problem

An air-conditioning apparatus according to the present invention includes a refrigerant circuit in which at least a compressor, a heat-source-side heat exchanger, expansion means, and a use-side heat exchanger are connected by a refrigerant pipe, and through which a refrigerant is circulated, heating means that heats the compressor, first temperature detection means that detects a refrigerant temperature in the compressor, and control means that controls the heating means, wherein while the compressor is stopped, the control means calculates a change of the refrigerant temperature per a time on the basis of a detected value of the first temperature detection means, and changes a heating amount to the compressor by the heating means on the basis of the change rate of the refrigerant temperature.

According to the present invention, since the heating amount to the compressor is made proportional to the change rate of the refrigerant temperature change rate, it is possible to prevent supplying an excessive heating amount to a compressor, and to reduce power consumption while the air-conditioning apparatus is stopped.

DETAILED DESCRIPTION

Embodiment 1

Configuration Overview

Figure 1:
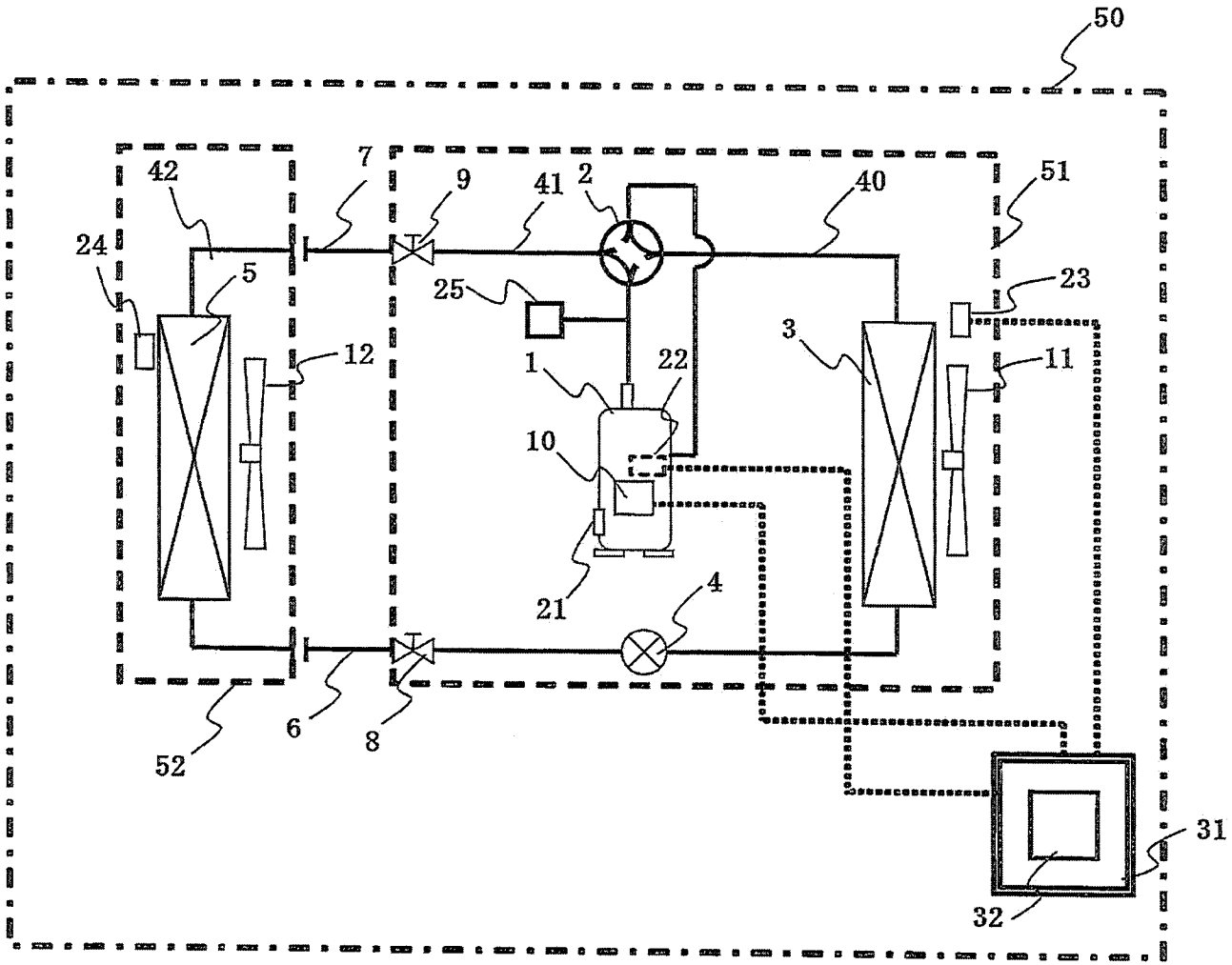
FIG. 1 is a refrigerant circuit diagram of an air-conditioning apparatus according to Embodiment 1 of the present invention.

FIG. 1 is a refrigerant circuit diagram of an air-conditioning apparatus according to Embodiment 1 of the present invention.

As illustrated in FIG. 1, an air-conditioning apparatus 50 includes a refrigerant circuit 40.

The refrigerant circuit 40 includes an outdoor refrigerant circuit 41 serving as a heat-source-side refrigerant circuit, and an indoor refrigerant circuit 42 serving as a use-side refrigerant circuit, which are connected by a liquid-side connection pipe 6 and a gas-side connection pipe 7, respectively.

The outdoor refrigerant circuit 41 is accommodated in an outdoor unit 51 that is installed outdoors, for example.

The outdoor unit 51 provides with an outdoor fan 11 that supplies outdoor air to the outdoor unit 51.

The indoor refrigerant circuit 42 is accommodated in an indoor unit 52 that is installed indoors, for example.

The indoor unit 52 provides with an indoor fan 12 that supplies indoor air to the indoor unit 52.

(Configuration of Outdoor Refrigerant Circuit)

The outdoor refrigerant circuit 41 includes a compressor 1, a four-way valve 2, an outdoor heat exchanger 3, an expansion valve 4, a liquid-side stop valve 8, and a gas-side stop valve 9, which are connected to in serial by a refrigerant pipe.

The liquid-side stop valve 8 is connected to the liquid-side connection pipe 6. The gas-side stop valve 9 is connected to the gas-side connection pipe 7. After installation of the air-conditioning apparatus 50, the liquid-side stop valve 8 and the gas-side stop valve 9 are in the open state.

Note that the "outdoor heat exchanger 3" corresponds to "heat-source-side heat exchanger" in the present invention.

The "expansion valve 4" corresponds to "expansion means" in the present invention.

(Configuration of Indoor Refrigerant Circuit)

The indoor refrigerant circuit 42 includes an indoor heat exchanger 5.

One end of the indoor refrigerant circuit 42 is connected to the liquid-side stop valve 8 through the liquid-side connection pipe 6, while the other end is connected to the gas-side stop valve 9 through the gas-side connection pipe 7.

Note that the "indoor heat exchanger 5" corresponds to "use-side heat exchanger" in the present invention.

(Description of Compressor)

Figure 2:
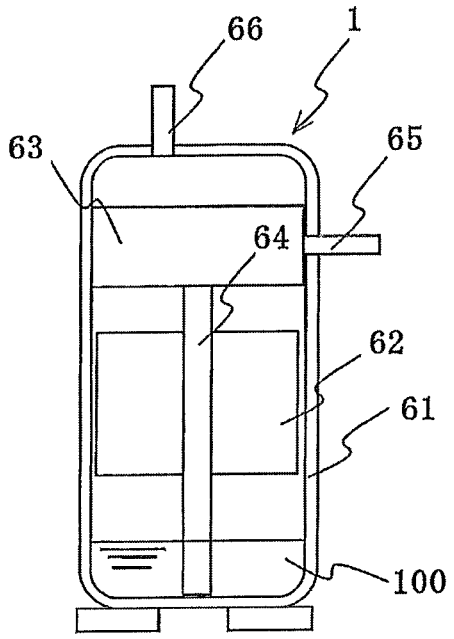
FIG. 2 is a simplified internal structural diagram of a compressor according to Embodiment 1 of the present invention.

FIG. 2 is a simplified internal structural diagram of a compressor according to Embodiment 1 of the present invention.

The compressor 1 is a hermetic compressor as illustrated in FIG. 2, for example. The compressor 1 includes a compressor shell unit 61 that forms the outer shell of the compressor 1.

The compressor shell unit 61 accommodates a motor unit 62 and a compression unit 63.

The compressor 1 includes a suction unit 66 that suctions the refrigerant into the compressor 1.

The compressor 1 further includes a discharge unit 65 that discharges the compressed refrigerant.

The refrigerant suctioned through the suction unit 66 is suctioned into the compression unit 63 so as to be compressed. The refrigerant compressed in the compression unit 63 is temporarily released into the compressor shell unit 61. The refrigerant released into the compressor shell unit 61 is sent to the refrigerant circuit 40 through the discharge unit 65. At this point, the compressor 1 has a high pressure inside.

(Description of Compressor Motor)

The motor unit 62 of the compressor 1 is a three-phase motor, for example, and receives a power supply from an inverter (not illustrated).

When the output frequency of the inverter changes, the rotation speed of the motor unit 62 changes, and the compression capacity of the compression unit 63 changes.

(Description of Air Heat Exchanger)

The outdoor heat exchanger 3 and the indoor heat exchanger 5 are fin-and-tube type heat exchangers, for example.

The outdoor heat exchanger 3 exchanges heat between outdoor air supplied from the outdoor fan 11 and the refrigerant in the refrigerant circuit 40.

The indoor heat exchanger 5 exchanges heat between indoor air supplied from the indoor fan 12 and the refrigerant in the refrigerant circuit 40.

(Description of Four-way Valve)

The four-way valve 2 is used for switching the flow in the refrigerant circuit 40.

Note that if there is no need to switch the flow of the refrigerant or if the air-conditioning apparatus 50 is used for cooling only or heating only, for example, the four-way valve 2 is not needed and may be removed from the refrigerant circuit 40.

(Description of Sensors)

In the air-conditioning apparatus 50, a temperature or pressure sensor is provided as necessary.

In FIG. 1, a compressor temperature sensor 21, a refrigerant temperature sensor 22, an outside air temperature sensor 23, an indoor temperature sensor 24, and a pressure sensor 25 are provided.

The compressor temperature sensor 21 detects the temperature (hereinafter referred to as a "compressor temperature") of the compressor 1 (compressor shell unit 61).

The refrigerant temperature sensor 22 detects the refrigerant temperature in the compressor 1.

The outside air temperature sensor 23 detects the temperature (hereinafter also referred to as an "outside air temperature") of air that exchanges heat with the refrigerant in the outdoor heat exchanger 3.

The indoor temperature sensor 24 detects the temperature (hereinafter also referred to as an "indoor temperature") of air that exchanges heat with the refrigerant in the indoor heat exchanger 5.

The pressure sensor 25 is disposed in a pipe on the refrigerant suction side of the compressor 1, for example, and detects a refrigerant pressure in the refrigerant circuit 40.

Note that the arrangement position of the pressure sensor is not limited to this position. The pressure sensor 25 may be provided at an arbitrary position in the refrigerant circuit 40.

Note that the "refrigerant temperature sensor 22" corresponds to "first temperature detection means" in the present invention.

The "compressor temperature sensor 21" corresponds to "second temperature detection means" in the present invention.

The "outside air temperature sensor 23" corresponds to "third temperature detection means" in the present invention.

The "indoor temperature sensor 24" corresponds to "fourth temperature detection means" in the present invention.

The "pressure sensor 25" corresponds to "pressure detection means" in the present invention.

(Description of Controller)

A controller 31 receives input of values detected by the sensors, and controls operations of the air-conditioning apparatus, such as capacity control of the compressor and heating control of a compressor heating unit 10 (described below), for example.

The controller 31 further includes an arithmetic device 32.

The arithmetic device 32 calculates a change rate of the refrigerant temperature per predetermined time (hereinafter referred to as a "refrigerant temperature change rate") on the basis of a value detected by the compressor temperature sensor 21. Also, the arithmetic device 32 includes a storage device (not illustrated) that stores a refrigerant temperature detected at a predetermined time before so as to be used for calculation, and a timer or the like (not illustrated) that measures lapse of the predetermined time.

The controller 31 adjusts the heating amount to the compressor heating unit 10 on the basis of a calculated value calculated by the arithmetic device 32, as will be described below in greater detail.

Note that the "controller 31" and the "arithmetic device 32" correspond to "control means" in the present invention.

(Description of Compressor Heating Unit)

The compressor heating unit 10 heats the compressor 1.

This compressor heating unit 10 may include the motor unit 62 of the compressor 1, for example. In this case, the controller 31 energizes the motor unit 62 of the compressor 1 having an open phase while the air-conditioning apparatus 50 is stopped, that is, while the compressor 1 is stopped. As a result, the motor unit 62 that has been energized while having an open phase does not rotate, and the current flowing through the coil generates Joule heat, which heats the compressor 1. That is, while the air-conditioning apparatus 50 is stopped, the motor unit 62 serves as the compressor heating unit 10.

Note that the compressor heating unit 10 may be any device that heats the compressor 1, and is not limited to thereto. For example, an electric heater may be provided separately.

Note that the "compressor heating unit 10" corresponds to "heating means" in the present invention.

Next, a description will be given of the principle of the refrigerant stagnating in the compressor 1 while the air-conditioning apparatus 50 is stopped and the advantages of heating the compressor 1.

(Description 1 of Principle of Refrigerant Accumulation in Compressor)

While the air-conditioning apparatus 50 is stopped, the refrigerant in the refrigerant circuit 40 condenses and stagnates in a portion having the lowest temperature among the components.

Therefore, if the temperature of the compressor 1 is lower than the temperature of the refrigerant, the refrigerant is likely to stagnate in the compressor 1.

(Description 2 of Principle of Refrigerant Accumulation in Compressor)

The compressor 1 is a hermetic compressor as illustrated in FIG. 2, for example. In the compressor 1, lubricant 100 is stored.

When the compressor 1 is operated, the lubricant 100 is supplied to the compression unit 63 and a rotating shaft 64 so as to provide lubrication.

When the refrigerant condenses and stagnates in the compressor 1, the refrigerant dissolves in the lubricant 100. This reduces the concentration of the lubricant 100 and thus reduces the viscosity thereof.

If the compressor 1 is started under such a condition, the lubricant 100 having low viscosity is supplied to the compression unit 63 and the rotating shaft 64. This may result in burnout due to insufficient lubrication.

Furthermore, the stagnant refrigerant raises the liquid level in the compressor. This increases the starting load of the compressor 1. The increased starting load is identified as an overcurrent at the start-up of the air-conditioning apparatus 50. Thus, the air-conditioning apparatus 50 may fail to start.

(Description of Advantages in Heating Compressor)

While the air-conditioning apparatus 50 is stopped, the controller 31 controls the compressor heating unit 10 to heat the compressor 1. Thus, the refrigerant dissolved in the lubricant 100 in the compressor 1 evaporates, so that the amount of the refrigerant dissolved in the lubricant 100 decreases.

Further, the compressor is heated so as to maintain the compressor temperature higher than the refrigerant temperature. This makes it possible to prevent condensation of the refrigerant in the compressor 1, and to prevent a decrease in concentration of the lubricant 100.

Figure 3:
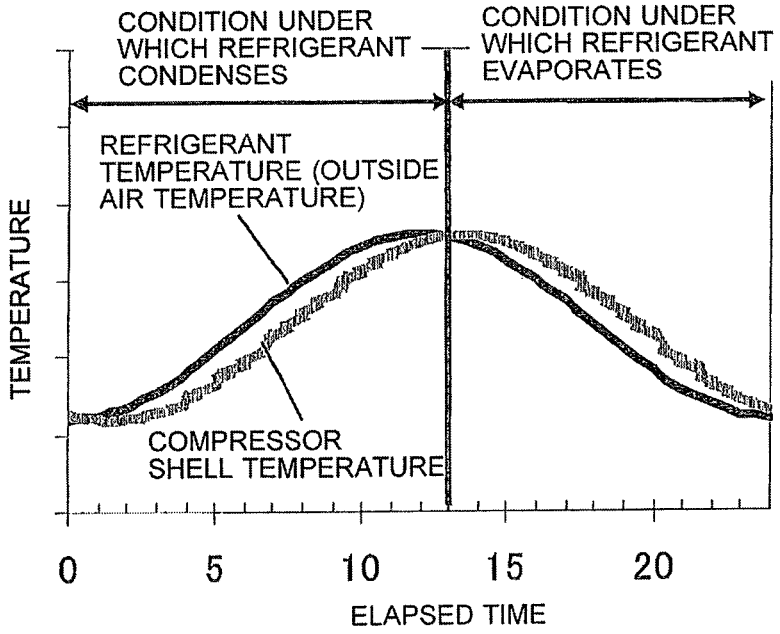
FIG. 3 is a graph illustrating the relationship between the refrigerant temperature and the compressor shell temperature according to Embodiment 1 of the present invention.

FIG. 3 is a graph illustrating a relationship between the refrigerant temperature and the compressor shell temperature according to Embodiment 1 of the present invention.

As illustrated in FIG. 3, when the refrigerant temperature changes, the temperature (hereinafter also referred to as a "shell temperature") of the compressor shell unit 61 of the compressor 1 also changes accordingly.

A change in the shell temperature always follows a change in the refrigerant temperature with a delay due to the heat capacity of the compressor 1.

Also, the condensation amount of the gas refrigerant presented in the compressor 1 varies in accordance with the temperature difference between the refrigerant temperature and the shell temperature as well as the length of time during which the temperature difference is maintained.

That is, when the shell temperature is lower than the refrigerant temperature, the greater the temperature difference therebetween is, the greater the amount of condensation heat is. Thus the heating amount to the compressor 1 increases so as to prevent condensation of refrigerant.

On the other hand, when the difference between the refrigerant temperature and the shell temperature is small, the condensation amount in the compressor 1 is small. Thus the heating amount to the compressor 1 is small.

Changes in the shell temperature of the compressor 1 are affected by the heat capacity of the compressor 1. Accordingly, if the relationship between the refrigerant temperature change rate and the amount of condensate in the compressor 1 is known in advance, the required heating capacity can be determined from the amount of change in the refrigerant temperature in a predetermined time.

That is, the controller 31 and the arithmetic device 32 increase or decreases the heating amount to the compressor 1 in proportion to the refrigerant temperature change rate not so as to supply an excessive heating amount to the compressor 1. Thus, it is possible to reduce power consumption while the air-conditioning apparatus 50 is stopped.

Next, a description will be given of the relationship between the refrigerant temperature change rate in the compressor 1 and the heating amount to be supplied to the compressor 1 which is required to prevent condensation of refrigerant in the compressor 1.

(Relationship Between Refrigerant Temperature Change Rate and Required Heat Amount)

First, a description will be given of the relationship of a refrigerant temperature Tr in the compressor 1, a compressor temperature Ts of the compressor 1, and a liquid refrigerant amount Mr in the compressor 1.

It is assumed that the compressor temperature Ts is lower than the refrigerant temperature Tr such that the refrigerant accumulates in the compressor 1.

The relationship between a heat exchange amount Qr (condensation capacity) of the compressor 1 required for the refrigerant in the compressor 1 to condense, the refrigerant temperature Tr, and the compressor temperature Ts is represented by Expression (1).

$$Qr=A\cdot K\cdot(Tr-Ts) \tag{1}$$

where A is an area of heat exchange between the compressor 1 and the refrigerant in the compressor 1; and K is an overall heat transfer coefficient between the compressor 1 and the refrigerant in the compressor 1.

On the other hand, since the refrigerant in the compressor 1 condenses due to the temperature difference between the compressor temperature Ts and the refrigerant temperature Tr, the relationship between a heat exchange amount Qr and a liquid refrigerant amount change dMr in a predetermined time dt is represented by Expression (2).

$$Qr=dMr\times dH/dt \tag{2}$$

where dH is evaporation latent heat of the refrigerant.

From Expression (1) and Expression (2), the relationship between the liquid refrigerant amount change dMr in the compressor 1, the refrigerant temperature Tr, and the compressor temperature Ts in a predetermined time interval (predetermined time dt) is represented by Expression (3).

$$dMr/dt=C1\cdot(Tr-Ts) \tag{3}$$

Assuming that a state under Ts<Tr has continued from time t1 (liquid refrigerant amount Mr1) to t2 (liquid refrigerant amount Mr2), then from the expression (3), the liquid refrigerant amount change dMr (=Mr2−Mr1) condensed in the compressor 1 is represented by Expression (4).

$$dMr=Mr2-Mr1=\int C1\cdot(Tr-Ts)\times dt \tag{4}$$

where C1 is a fixed value, which is obtained by dividing a product of a heat transfer area A and an overall heat transmission coefficient K by the evaporation latent heat dH.

If amount of heat transferred from and the amount of heat received in the compressor shell unit 61 of the compressor 1 may be disregarded, the compressor temperature Ts depends on the refrigerant temperature Tr and is determined by the heat capacity of the compressor shell unit 61.

That is, Tr−Ts depends on an amount of change dTr in the refrigerant temperature Tr. Thus, if the refrigerant temperature Tr changes from a certain temperature by dTr and becomes stable, the liquid refrigerant amount change dMr may be represented by Expression (5).

$$dMr=C2\cdot dTr \tag{5}$$

where C2 is a proportionality constant that can be obtained from the test results or by a theoretical calculation.

From Expression (2) and Expression (5), the heat exchange amount Qr of the compressor 1 may be represented by Expression (6).

$$Qr=C2\cdot dH\cdot dTr/dt \tag{6}$$

Figure 4:
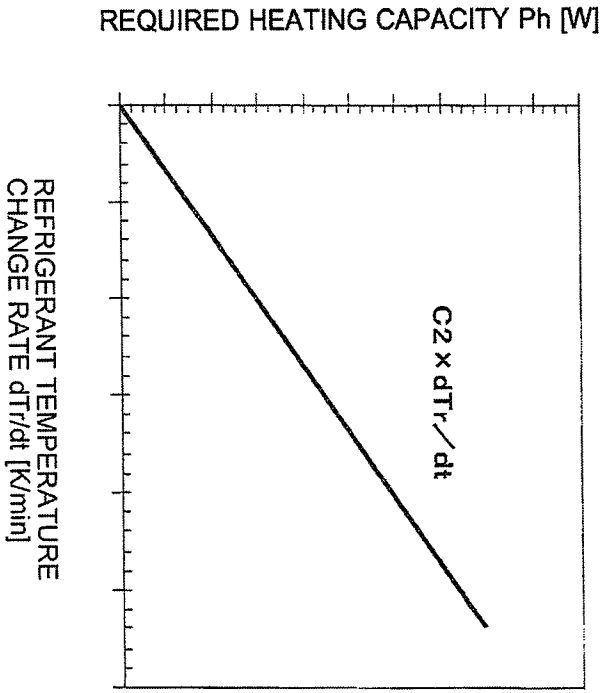
FIG. 4 is a graph illustrating the relationship between the refrigerant temperature change rate and the required heating capacity according to Embodiment 1 of the present invention.

FIG. 4 is a graph illustrating a relationship between the refrigerant temperature change rate and the required heating capacity according to Embodiment 1 of the present invention.

In order to prevent condensation of the refrigerant in the compressor 1, a heating amount that matches the heat exchange amount Qr (condensation capacity) of the compressor 1 generated upon changes in the refrigerant temperature Tr may be supplied to the compressor 1.

A required heating capacity Ph that is required to achieve this heating amount during a predetermined heating time has a relationship represented by Expression (7).

That is, as illustrated in FIG. 4, the required heating capacity Ph is proportional to the refrigerant temperature change rate (dTr/dt), which is a ratio between the amount of change dTr in the refrigerant temperature Tr and the predetermined time dt.

$$Ph\propto C2\cdot dH\cdot(dTr/dt) \tag{7}$$

That is, as the refrigerant temperature change rate (dTr/dt) is large, the heat exchange amount Qr (condensation capacity) of the compressor 1 increases, and then the required heating capacity Ph increases.

On the other hand, as the refrigerant temperature change rate (dTr/dt) is small, the heat exchange amount Qr (condensation capacity) of the compressor 1 decreases, and the required heating capacity Ph decreases.

As described above, the heating capacity to be supplied to the compressor 1 which is required to prevent condensation of refrigerant in the compressor 1 can be determined from the refrigerant temperature change rate (dTr/dt).

(Description of Heating Control Operation)

Next, a description will be given of heating control of the compressor 1 of Embodiment 1 with reference to FIG. 5.

Figure 5:
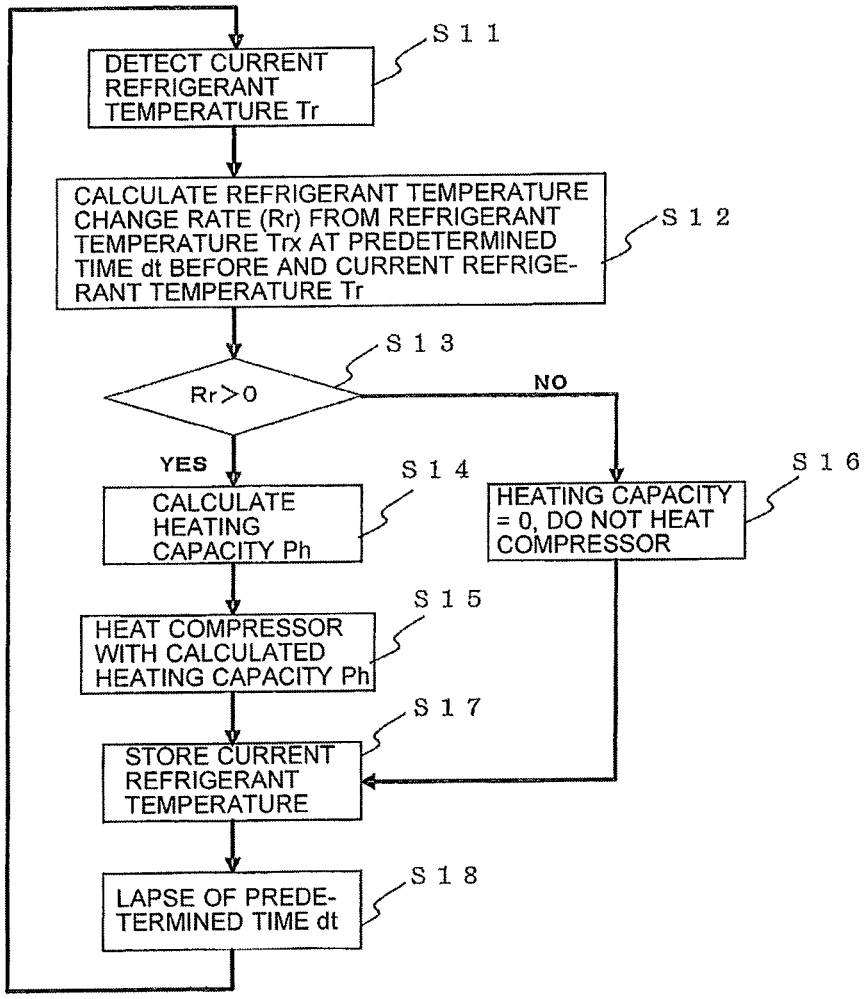
FIG. 5 is a flowchart illustrating a control operation according to Embodiment 1 of the present invention.

FIG. 5 is a flowchart illustrating a control operation according to Embodiment 1 of the present invention.

The following describes the steps in FIG. 5.

(S11)

While the air-conditioning apparatus 50 is stopped, the controller 31 detects a current refrigerant temperature Tr with the refrigerant temperature sensor 22.

(S12)

The arithmetic device 32 of the controller 31 calculates a refrigerant temperature change rate Rr (=(dTr/dt)=(Tr−Trx)/dt)) on the basis of the detected current refrigerant temperature Tr and a refrigerant temperature Trx (described below) that is stored at a predetermined time dt before.

In the case where the refrigerant temperature Trx at the predetermined time dt before is not stored, such as when the air-conditioning apparatus 50 is operated for the first time, the process skips Steps S12 through S16 and proceeds to Step S17.

(S13)

The controller 31 determines whether the calculated refrigerant temperature change rate Rr is greater than zero.

If the refrigerant temperature change rate Rr is greater than zero, the process proceeds to Step S14.

If the refrigerant temperature change rate Rr is zero or less, the process proceeds to Step S16.

(S14)

The arithmetic device 32 of the controller 31 calculates a required heating capacity Ph for the compressor 1 which is proportional to the calculated refrigerant temperature change rate Rr (=dTr/dt).

The required heating capacity Ph may be calculated by multiplying the refrigerant temperature change rate Rr by a predetermined coefficient that is set in advance, for example.

The required heating capacity Ph may also be calculated as follows. The calculated refrigerant temperature change rate Rr (=dTr/dt) is substituted into the above Expression (6) to obtain a heat exchange amount Qr. Then, a heating amount to the compressor 1 that matches the heat exchange amount Qr is obtained. Then, a heating capacity required to achieve the calculated heating amount during a predetermined heating time (=predetermined time dt) is calculated as the required heating capacity Ph (=Qr/dt).

(S15)

The controller 31 sets the heating capacity of the compressor heating unit 10 to the calculated required heating capacity Ph, and heats the compressor 1 for the predetermined heating time (=predetermined time dt).

In the above description, the predetermined time dt is used as the predetermined heating time. The present invention, however, is not limited thereto. For example, a time shorter than the predetermined time dt may be used as the heating time, and a great heating capacity may be provided in a short time. Also, the heating capacity may be increased or decreased step by step. That is, an integrated value of the heating capacity in the predetermined time dt may match the heating amount.

(S16)

On the other hand, if the refrigerant temperature change rate Rr is zero or less, the arithmetic device 32 of the controller 31 sets the required heating capacity Ph to zero. The controller 31 causes the compression heating unit 10 to stop heating the compressor 1.

That is, if the refrigerant temperature change rate Rr is zero or less, the refrigerant temperature Trx at the predetermined time dt before is higher than the current refrigerant temperature Tr, and hence the refrigerant does not condense. Therefore, heating of the compressor 1 is not performed.

(S17)

After the compressor 1 is heated for the predetermined time in Step S15, or after heating of the compressor 1 is stopped in Step S16, the controller 31 stores the current refrigerant temperature Tr in the storage device of the arithmetic device 32.

(S18)

The controller 31 measures lapse of the predetermined time dt with the timer or the like in the arithmetic device 32. After lapse of the predetermined time dt, the process returns to Step S11 so as to repeat the steps described above.

Next, a description will be given of an example of the result of the above-described heating control of the compressor 1, with reference to FIG. 6.

Figure 6:
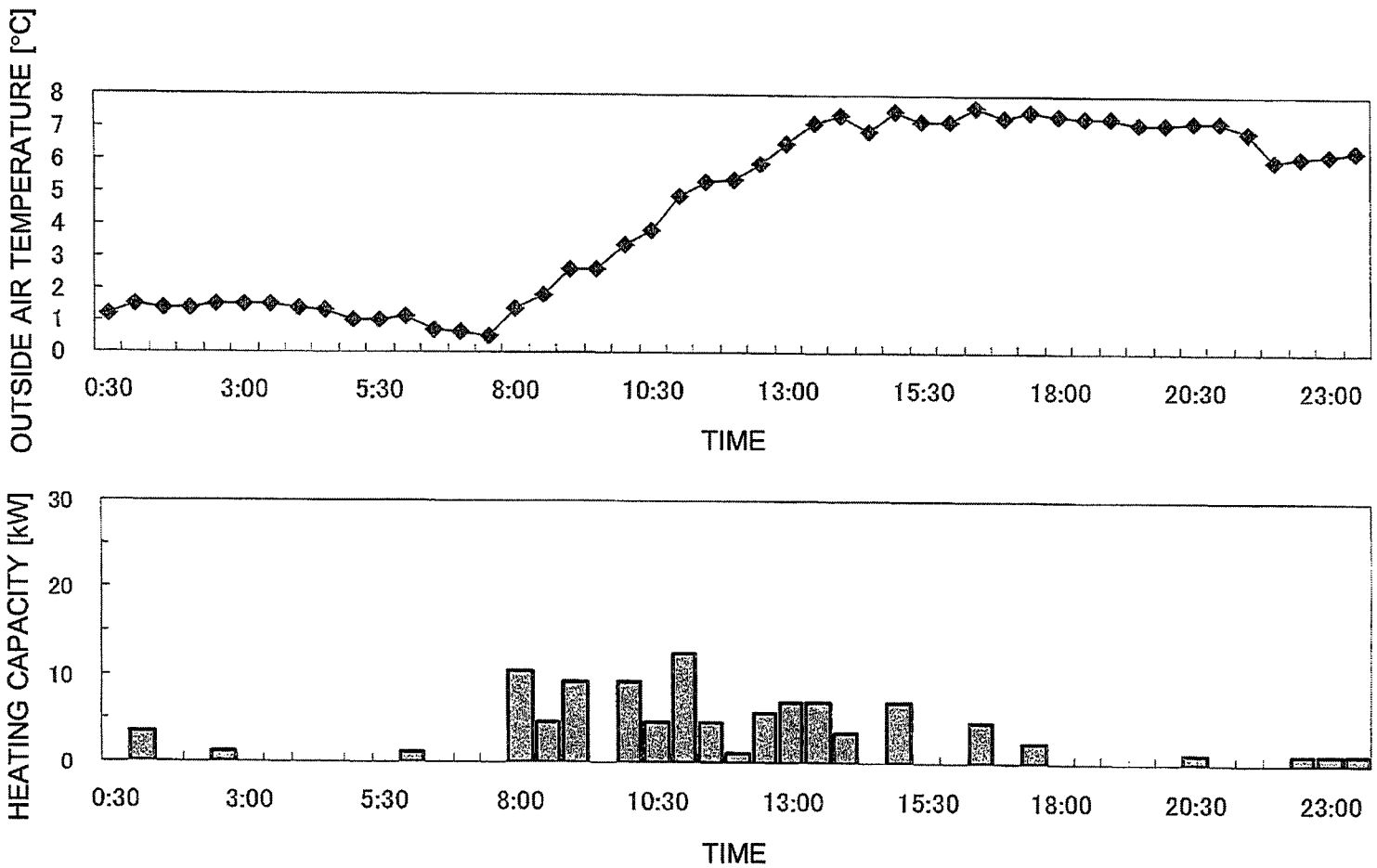
FIG. 6 is a graph illustrating the relationship between changes in the outside air temperature and the heating capacity in that period according to Embodiment 1 of the present invention.

Note that FIG. 6 illustrates the relationship between changes in the outside air temperature and the heating capacity in that period. The outdoor heat exchanger 3 installed outdoors has a large surface area that is in contact with outside air, and the heat capacity thereof is relatively low in general. Therefore, if the outside air temperature changes, the refrigerant temperature changes almost the same time. For this reason, the outside air temperature is used.

FIG. 6 is a graph illustrating the relationship between changes in the outside air temperature and the heating capacity in that period according to Embodiment 1.

The upper graph in FIG. 6 illustrates the relationship between the outside air temperature and time. The lower graph in FIG. 6 illustrates the heating capacity of the compressor heating unit 10 in the above-described heating operation. Note that the predetermined time dt is 30 minutes.

As illustrated in FIG. 6, while the outside air temperature (refrigerant temperature) is constant or decreasing, the refrigerant temperature change rate Rr is zero or less, and hence the heating capacity is zero.

In this way, when the shell temperature is higher than the refrigerant temperature and thus condensation of the refrigerant does not occur, it is possible to stop heating the compressor 1.

On the other hand, when the outside air temperature (refrigerant temperature) increases, the heating capacity increases or decreases in proportion to the change rate.

In this way, while the outside air temperature (refrigerant temperature) increases, a heating amount that matches the heat exchange amount Qr (condensation capacity) of the compressor 1 is supplied to the compressor 1. Thus, it is possible to prevent condensation of refrigerant in the compressor 1 without supplying an excessive heating amount to the compressor 1.

Advantages of Embodiment 1

As described above, according to Embodiment 1, while the compressor 1 is stopped, the change rate of the refrigerant temperature Tr per predetermined time dt is calculated on the basis of a value detected by the refrigerant temperature sensor 22, and the heating amount from the compressor heating unit 10 to the compressor 1 is made proportional to the change rate of the refrigerant temperature Tr.

Accordingly, it is possible to prevent the refrigerant from condensing and stagnating in the compressor 1, without supplying an excessive heating amount to the compressor 1. Thus, it is possible to suppress power consumption while the air-conditioning apparatus is stopped, that is, standby power.

Further, since condensation of the refrigerant in the compressor 1 is prevented, it is possible to suppress a decrease in the concentration of the lubricant. Thus, it is possible to prevent burnout in the compressor 1 due to insufficient lubrication, and to prevent an increase in the starting load of the compressor.

Further, according to Embodiment 1, if the change rate of the refrigerant temperature Tr is zero or less, heating to the compressor 1 by the compressor heating unit 10 is stopped.

Thus, it is possible to stop heating the compressor 1 when condensation of the refrigerant does not occur. Accordingly, it is possible to prevent supplying an excessive heating amount to the compressor 1, and to reduce power consumption while the air-conditioning apparatus 50 is stopped.

Further, the refrigerant temperature change rate Rr is calculated on the basis of the current refrigerant temperature Tr and the refrigerant temperature Trx at the predetermined time dt before which are detected by the refrigerant temperature sensor 22.

Further, the heating capacity of the compressor heating unit 10 is changed so as to achieve the heating amount during a predetermined heating time.

Thus, it is possible to supply, to the compressor 1, a heating amount that matches the heat exchange amount Qr (condensation capacity) of the compressor 1 generated upon changes in the refrigerant temperature Tr, and thus to prevent condensation of the refrigerant in the compressor 1.

Accordingly, it is possible to prevent the refrigerant from condensing and stagnating in the compressor 1, without supplying an excessive heating amount to the compressor 1.

Embodiment 2

Estimation of Refrigerant Temperature

In Embodiment 2, an aspect will be described in which a refrigerant temperature Trp after the predetermined time dt is estimated, and the refrigerant temperature change rate is calculated on the basis of the refrigerant temperature Trp after the predetermined time dt and the current refrigerant temperature Tr.

Note that the configuration in Embodiment 2 is the same as that in Embodiment 1, and the same components are denoted by the same reference numerals.

Figure 7:
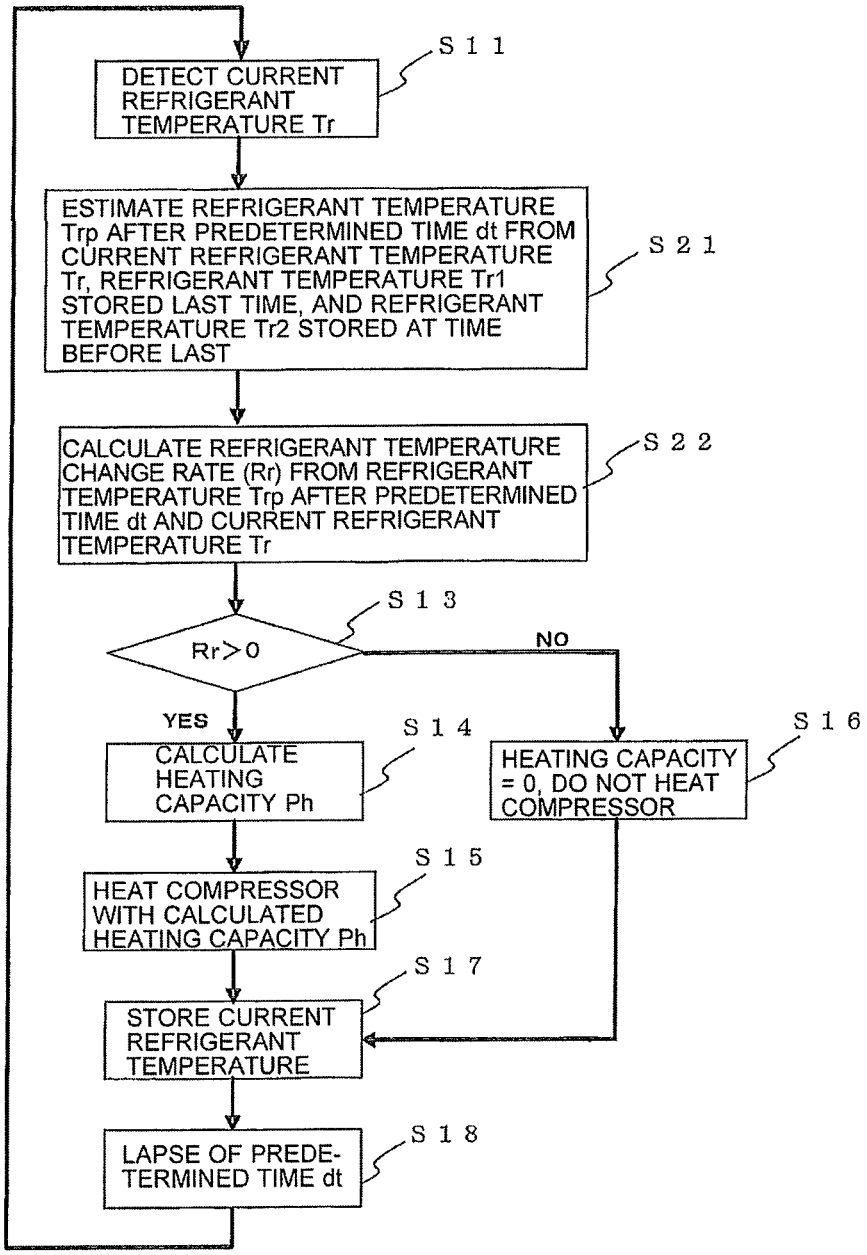
FIG. 7 is a flowchart illustrating a control operation according to Embodiment 2 of the present invention.

FIG. 7 is a flowchart illustrating a control operation according to Embodiment 2 of the present invention.

The following describes the steps in FIG. 7, in particular the differences from the above Embodiment 1 (FIG. 5).

Note that steps that are the same as those in the above Embodiment 1 are denoted by the same reference numerals.

(S21)

The arithmetic device 32 of the controller 31 estimates the refrigerant temperature Trp after the predetermined time dt from the current time, on the basis of the current refrigerant temperature Tr detected in Step S11, the refrigerant temperature Tr1 at the predetermined time dt before that is stored in the last Step S17, and the refrigerant temperature Tr2 stored in Step S17 before last (the predetermined time dt prior to the refrigerant temperature Tr1).

In the case where the refrigerant temperatures Tr1 and Tr2 are not stored, such as when the air-conditioning apparatus 50 is operated for the first time, the process skips Steps S21, S22, and S13 through S16 and proceeds to Step S17.

This estimation method can be applied with an arbitrary method. The refrigerant temperature Trp after the predetermined time dt may be estimated by using a statistical method such as a least-squares method, for example.

Also, a change rate of the increments between the refrigerant temperatures Tr and Tr1 and between Tr1 and Tr2 may be calculated, and thus the refrigerant temperature Trp after the predetermined time dt may be estimated on the basis of this change rate.

Also, changes in the outside air temperature for the past day may be sequentially stored, and thus the refrigerant temperature Trp may be estimated by comparing the changes in the outside air temperature with the detected refrigerant temperatures Tr, Tr1, and Tr2.

In the example described in Embodiment 2, the refrigerant temperature Tr1 after the predetermined time dt is estimated on the basis of the current refrigerant temperature Tr, the last refrigerant temperature Tr1, and the refrigerant temperature Tr2 before last. The present invention, however, is not limited thereto.

The refrigerant temperature Trp after the predetermined time dt may be estimated on the basis of at least the current refrigerant temperature Tr and the refrigerant temperature Tr1 at the predetermined time dt before.

Also, the estimation may be performed on the basis of refrigerant temperatures Trn (n=3, 4, . . . ) that are detected further prior to the refrigerant temperature Tr2 before the last.

(S22)

The arithmetic device 32 of the controller 31 calculates a refrigerant temperature change rate Rr (=(dTr/dt)=(Trp−Tr)/dt)) on the basis of the refrigerant temperature Trp after the predetermined time dt that is estimated in Step S22 and the current refrigerant temperature Tr that is detected in Step S11.

Then, as in the case of the above Embodiment 1, Steps S13 through S18 are performed.

Advantages of Embodiment 2

As described above, according to Embodiment 2, the refrigerant temperature Trp after the predetermined time dt is estimated on the basis of at least the current refrigerant temperature Tr and the refrigerant temperature Tr1 at the predetermined time dt before, which are detected by the refrigerant temperature sensor 22. Then, the refrigerant temperature change rate Rr is obtained on the basis of the refrigerant temperature Trp after the predetermined time dt and the current refrigerant temperature Tr.

Thus, even in the case where the outside air temperature is continuously changing and the refrigerant temperature is also changing accordingly, it is possible to estimate the heating amount to be required after lapse of the predetermined time, and thus to reduce the risk of the heating amount becoming insufficient after the predetermined time.

Accordingly, it is possible to supply, to the compressor 1, a heating amount corresponding to changes in the refrigerant temperature, and thus to suppress condensation of refrigerant in the compressor 1.

Embodiment 3

Calculating Heating Amount from Shell Temperature and Refrigerant Temperature In Embodiment 3, the heating amount calculation operation performed by the controller 31 is different from those of the above Embodiments 1 and 2.

Note that the configuration in Embodiment 3 is the same as that in Embodiment 1, and the same components are denoted by the same reference numerals.

The controller 31 of Embodiment 3 obtains a temperature difference (Tr−Ts) between a refrigerant temperature Tr detected by the refrigerant temperature sensor 22 and a compressor temperature Ts detected by the compressor temperature sensor 21, while the compressor 1 is stopped.

The temperature difference (Tr−Ts) is substituted into the above Expression (1) to obtain a heat exchange amount Qr upon condensation of the refrigerant in the compressor 1.

Then, the controller 31 makes the heating amount to the compressor 1 by the compressor heating unit 10 proportional to the heat exchange amount Qr.

For example, the controller 31 sets the heating capacity of the compressor heating unit 10 so as to achieve a heating amount that matches the heat exchange amount Qr during the predetermined heating time (=predetermined time dt).

Advantages of Embodiment 3

As described above, according to Embodiment 3, the heat exchange amount Qr upon condensation of the refrigerant in the compressor 1 is obtained on the basis of the difference between the refrigerant temperature Tr detected by the refrigerant temperature sensor 22 and the compressor temperature Ts detected by the compressor temperature sensor 21, while the compressor 1 is stopped. Then, the heating amount to the compressor 1 by the compressor heating unit 10 is made proportional to the heat exchange amount Qr.

Accordingly, even if the compressor 1 is affected by the ambient environment, it is possible to estimate the heating amount required by the compressor 1 with high accuracy, and thus to further suppress power consumption while the air-conditioning apparatus 50 is stopped, that is, standby power.

Embodiment 4

Constant Heating Amount Control

In Embodiment 4, an aspect will be described in which the heating capacity of the compressor heating unit 10 is set to a predetermined value, and the length of the heating time is changed so as to achieve the calculated heating amount.

Note that the configuration in Embodiment 4 is the same as that in Embodiment 1, and the same components are denoted by the same reference numerals.

The operation of calculating the heating amount is the same as any of those in the above Embodiments 1 through 3.

Figure 8:
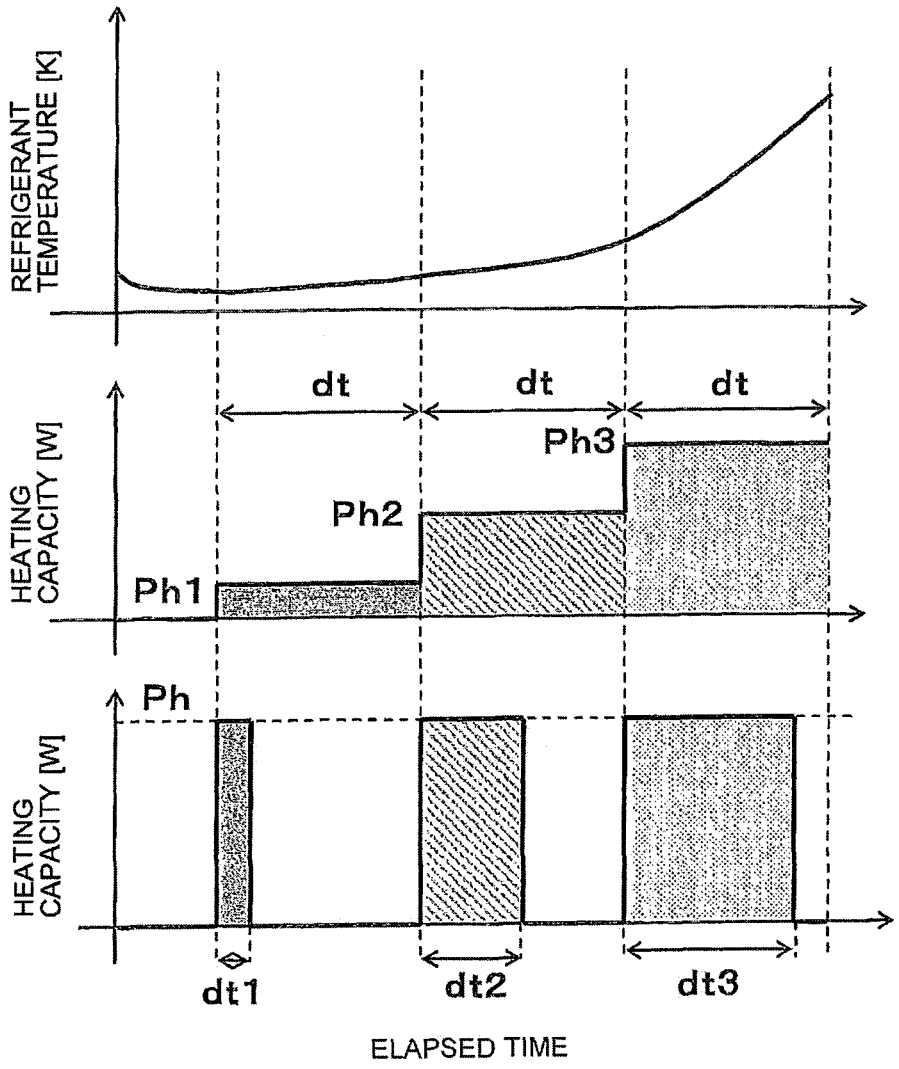
FIG. 8 is a graph illustrating an operation in the case where the heating time and the heating capacity are changed according to Embodiment 4 of the present invention.

FIG. 8 is a graph illustrating an operation in the case where the heating time and the heating capacity are changed in Embodiment 4 of the present invention.

The upper graph in FIG. 8 illustrates the relationship between the refrigerant temperature and the elapsed time.

The middle graph in FIG. 8 illustrates the relationship between the heating capacity and the elapsed time in the case where the heating capacity of the compressor heating unit 10 is changed.

The lower graph in FIG. 8 illustrates the relationship between the heating capacity and the elapsed time in the case where the heating time of the compressor heating unit 10 is changed.

In the above Embodiments 1 through 3, as illustrated in the middle graph in FIG. 8, a desired heating amount is supplied to the compressor 1 by changing the heating capacity Ph during the predetermined time dt.

In this case, a heating amount W supplied to the compressor 1 may be represented by Expression (8).

$$W=Ph\times dt \tag{8}$$

That is, the heating amount W is an amount of heat that is required to be supplied to the compressor during the predetermined time dt. Therefore, as illustrate in the lower graph in FIG. 8, it is possible to supply the desired heating amount W, even by fixing the heating capacity Ph to a predetermined value and changing the length of the predetermined time dt so as to match the heating amount W.

Accordingly, the controller 31 of Embodiment 4 makes the heating capacity of the compressor heating unit 10 set to a predetermined value (to be constant), and changes the length of the heating time so as to achieve the calculated heating amount.

Advantages of Embodiment 4

As described above, according to Embodiment 4, the heating capacity of the compressor heating unit 10 is set to a predetermined value, and the length of the heating time is changed so as to achieve the heating amount.

Thus, the same advantages as those of the above Embodiments 1 through 3 can be obtained.

Further, since the heating capacity of the compressor heating unit 10 is set to a predetermined value (to be constant), it is not necessary for a control operation to set the heat capacity, and it is possible to simply the control operation of the controller 31 by simple On/Off operation. Accordingly, it is possible to simplify the configuration of the controller 31, and to reduce the costs.

Embodiment 5

Calculating Refrigerant Temperature from Pressure

In Embodiment 5, an aspect will be described in which the refrigerant pressure is converted into a refrigerant saturation gas temperature, and the refrigerant saturation gas temperature is used as a refrigerant temperature Tr.

Note that the configuration in Embodiment 5 is the same as that in Embodiment 1, and the same components are denoted by the same reference numerals.

The operation of calculating the heating amount is the same as any of those in the above Embodiments 1 through 4.

Figure 9:
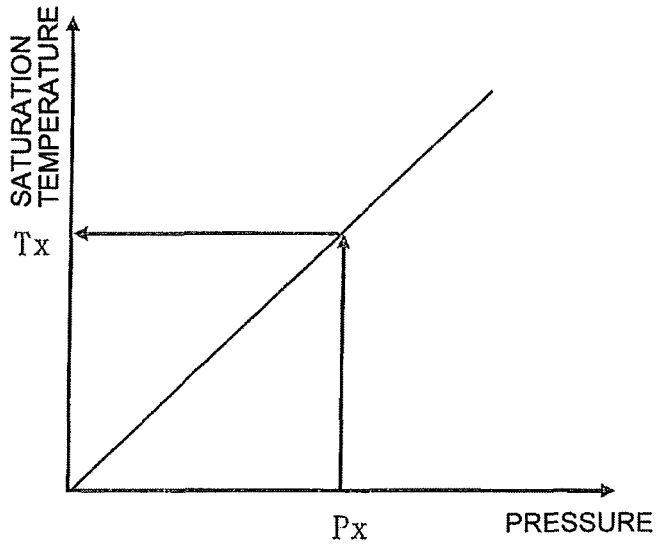
FIG. 9 is a graph illustrating the relationship between the pressure and the saturation temperature according to Embodiment 5 of the present invention.

FIG. 9 is a graph illustrating the relationship between the pressure and the saturation temperature according to Embodiment 5 of the present invention.

While the compressor 1 is stopped, the pressure in the refrigerant circuit 40 becomes uniform throughout (pressure equalization).

Further, the refrigerant circuit 40 is a closed circuit, and if liquid refrigerant is present in the circuit, the value detected by the pressure sensor 25 is a saturation pressure. Accordingly, as illustrated in FIG. 9, the refrigerant pressure can be converted into a saturation temperature.

Then, since the refrigerant temperature in the refrigerant circuit 40 is the saturation temperature, while the compressor 1 is stopped, the controller 31 of Embodiment 5 converts the refrigerant pressure detected by the pressure sensor 25 into a refrigerant saturation gas temperature. Then, this refrigerant saturation gas temperature is used as the refrigerant temperature Tr.

Advantages of Embodiment 5

As described above, according to Embodiment 5, while the compressor 1 is stopped, the refrigerant pressure detected by the pressure sensor 25 is converted into a refrigerant saturation gas temperature. Then, the refrigerant saturation gas temperature is used as the refrigerant temperature Tr.

Therefore, it is possible to get the refrigerant temperature directly, and thus to calculate the heating amount with high accuracy.

Accordingly, it is possible to more reliably prevent refrigerant condensation or the like due to excessive heating or insufficient heating to the compressor 1. Thus, it is possible to improve the reliability while suppressing power consumption while the air-conditioning apparatus 50 is stopped, that is, standby power.

Embodiment 6

Controlling Heating Amount in Accordance with Evaporation Latent Heat

In Embodiment 6, an aspect will be described in which the heating amount is controlled in accordance with the evaporation latent heat which varies in accordance with the refrigerant pressure or the outdoor air temperature.

Note that the configuration in Embodiment 6 is the same as that in Embodiment 1, and the same components are denoted by the same reference numerals.

The operation of calculating the heating amount is the same as any of those in the above Embodiments 1 through 5.

Figure 10:
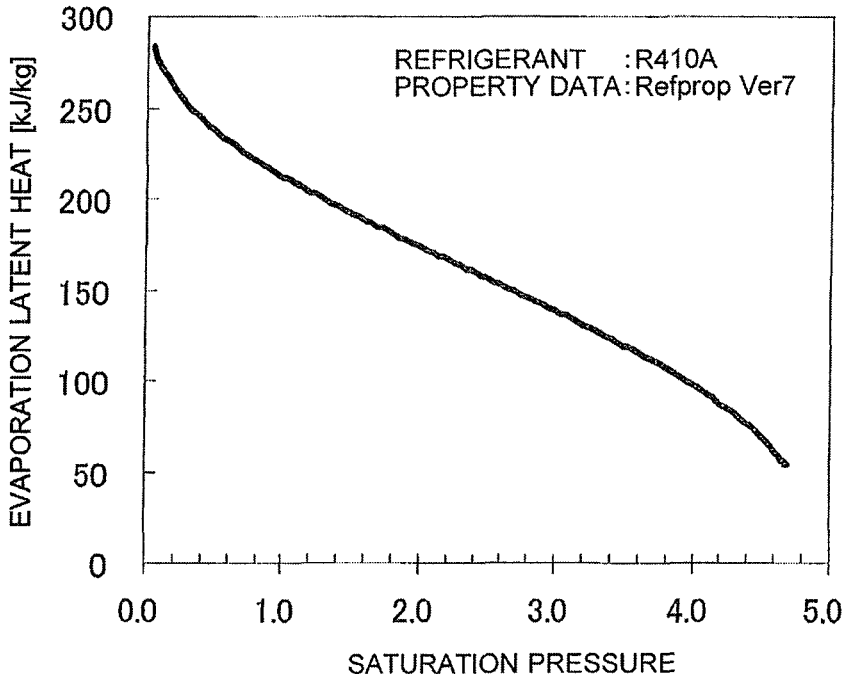
FIG. 10 is a graph illustrating the relationship between the saturation pressure and the evaporation latent heat according to Embodiment 6 of the present invention.

FIG. 10 is a graph illustrating the relationship between the saturation pressure and the evaporation latent heat according to Embodiment 6 of the present invention.

The evaporation latent heat dH of the refrigerant in the above Expression (2) and Expression (6) varies in accordance with the refrigerant pressure.

For example, in the case of R410A, as illustrated in FIG. 10, as the refrigerant pressure decreases, the evaporation latent heat decreases.

That is, the heat exchange amount Qr of the compressor 1 increases when the refrigerant pressure is low, and the heat exchange amount Qr of the compressor 1 decreases when the refrigerant pressure is high.

That is, in order to prevent the heating amount from becoming excessive or insufficient, even if the refrigerant temperature change rate is the same, when the refrigerant pressure is low, the heating amount to the compressor 1 needs to be increased. Further, when the refrigerant pressure is high, the heating amount to the compressor 1 may be reduced.

Accordingly, while the compressor 1 is stopped, the controller 31 of Embodiment 6 reduces the heating amount of the compressor heating unit 10 as the refrigerant pressure detected by the pressure sensor 25 increases.

Alternatively, the controller 31 reduces the heating amount of the compressor heating unit 10 as the temperature detected by the outside air temperature sensor 23 increases.

Advantages of Embodiment 6

As described above, according to Embodiment 6, while the compressor 1 is stopped, the heating amount of the compressor heating unit 10 is reduced as the refrigerant pressure detected by the pressure sensor 25 increases.

Alternatively, the heating amount of the compressor heating unit 10 is reduced as the temperature detected by the outside air temperature sensor 23 increases.

Accordingly, it is possible to supply, to the compressor 1, a heating amount corresponding to changes in the heat exchange amount Qr of the compressor 1, which is caused by changes in the evaporation latent heat of the refrigerant, and it is therefore possible to prevent condensation of refrigerant in the compressor 1 without supplying an excessive heating amount to the compressor 1.

Thus, it is possible to suppress power consumption while the air-conditioning apparatus is stopped, that is, standby power.

Embodiment 7

Alternative to Refrigerant Temperature

In Embodiment 7, an aspect will be described in which a value detected by the outside air temperature sensor 23 or the indoor temperature sensor 24 is used in place of the refrigerant temperature Tr.

Note that the configuration in Embodiment 7 is the same as that in Embodiment 1, and the same components are denoted by the same reference numerals.

The operation of calculating the heating amount is the same as any of those in the above Embodiments 1 through 6.

Since the outdoor heat exchanger 3 and the indoor heat exchanger 5 are heat exchangers that exchange heat between the refrigerant and air, the surface area in contact with the air is large.

Further, the outdoor heat exchanger 3 and the indoor heat exchanger 5 are typically formed of members made of metal that has a relatively high thermal conductivity, such as aluminum and copper, and the heat capacity thereof is relatively small.

For example, in the case where the surface area of the outdoor heat exchanger 3 is greater than that of the indoor heat exchanger 5 and the heat capacity of the outdoor heat exchanger 3 is greater than the heat capacity of the indoor heat exchanger 5, when the outside air temperature changes, the refrigerant temperature also changes almost at the same time. That is, the refrigerant temperature changes in the substantially same manner as the outside air temperature.

Accordingly, in the case where the heat capacity of the outdoor heat exchanger 3 is greater than the heat capacity of the indoor heat exchanger 5, while the compressor 1 is stopped, the controller 31 uses the temperature detected by the outside air temperature sensor 23 as the refrigerant temperature Tr.

On the other hand, in the case where the surface area of the indoor heat exchanger 5 is greater than that of the outdoor heat exchanger 3 and the heat capacity of the indoor heat exchanger 5 is greater than the heat capacity of the outdoor heat exchanger 3, when the indoor temperature changes, the refrigerant temperature also changes almost at the same time. That is, the refrigerant temperature changes in the substantially same manner as the indoor temperature.

Accordingly, in the case where the heat capacity of the indoor heat exchanger 5 is greater than the heat capacity of the outdoor heat exchanger 3, while the compressor 1 is stopped, the controller 31 uses the temperature detected by the indoor temperature sensor 24 as the refrigerant temperature Tr.

Advantages of Embodiment 7

As described above, according to Embodiment 7, the temperature detected by the outside air temperature sensor 23 or the indoor temperature sensor 24 is used as a refrigerant temperature Tr.

Therefore, it is not necessary for the refrigerant temperature sensor 22 to detect the refrigerant temperature in the compressor 1. Thus, it is possible to calculate the heating capacity to the compressor 1 by using the outside air temperature sensor 23 or the indoor temperature sensor 24 that is mounted on a general air-conditioning apparatus 50, and it is therefore possible to calculate the heating amount without complicating the configuration.

Embodiment 8

Countermeasure Against Influence of Draft

In Embodiment 8, an aspect will be described in which the heating amount is controlled in accordance with whether there is air passing through the outdoor heat exchanger 3.

Note that, in the configuration of Embodiment 8, a draft detection means (described below) is added to the configuration of Embodiment 1. The configuration other than this is the same as that of Embodiment 1, and the same components are denoted by the same reference numerals.

The operation of calculating the heating amount is the same as any of those in the above Embodiments 1 through 7.

As mentioned above, the outdoor unit 51 is provided with the outdoor fan 11 that supplies outdoor air to the outdoor heat exchanger 3. While the air-conditioning apparatus 50 is stopped, the outdoor fan 11 is stopped from driving, so that air is not supplied to the outdoor heat exchanger 3.

However, when outdoor air flows into the outdoor unit 51, air passes through the outdoor heat exchanger 3, so that the heat exchange amount between the refrigerant and air in the outdoor heat exchanger 3 increases.

Under conditions where the refrigerant condenses in the compressor 1, the variation of the refrigerant temperature is greater than when there is no air passing through the outdoor heat exchanger 3, and the refrigerant is more likely to condense.

In view of this, in Embodiment 8, draft detection means that detects whether there is air passing through the outdoor heat exchanger 3 is provided.

This draft detection means detects whether there is air passing through the outdoor heat exchanger 3 by detecting a potential difference induced by a fan motor that drives the outdoor fan 11, for example.

That is, while the outdoor fan 11 is stopped, if the outdoor fan 11 rotates due to air passing through the outdoor heat exchanger 3, a potential difference is generated in the fan motor. Thus, it is possible to detect whether there is air passing through the outdoor heat exchanger 3.

Note that the configuration of the draft detection means is not limited thereto. For example, an anemometer or the like may be provided in the vicinity of the outdoor heat exchanger 3.

While the compressor 1 is heated by the compressor heating unit 10, if the draft detection means detects that there is passing air, the controller 31 of Embodiment 8 increases the heating amount such that the heating amount becomes greater than when there is no passing air.

Advantages of Embodiment 8

As described above, according to Embodiment 8, while the compressor 1 is heated by the compressor heating unit 10, if the draft detection means detects that there is passing air, the heating amount is increased to be greater than when there is no passing air.

Therefore, in the case where the heat exchange amount between the refrigerant and air in the outdoor heat exchanger 3 is increased due to the outdoor air flowing into the outdoor unit 51 and thus the refrigerant is more likely to condense, the heating amount to the compressor 1 may be increased. This prevents the refrigerant from condensing and stagnating in the compressor 1.

Thus, it is possible to suppress power consumption while the air-conditioning apparatus is stopped, that is, standby power.

The invention claimed is:

1. An air-conditioning apparatus comprising:

a refrigerant circuit in which at least a compressor, a heat-source-side heat exchanger, expansion means, and a use-side heat exchanger are connected by a refrigerant pipe, and through which a refrigerant is circulated;

heating means that heats the compressor;

a first temperature detection sensor that detects a refrigerant temperature that is a temperature of the refrigerant located in the compressor; and a controller that controls the heating means, wherein while the compressor is stopped, the controller calculates a change rate of the refrigerant temperature per a time on the basis of a value detected by the first temperature detection sensor, and changes a heating amount to the compressor by the heating means to be proportional to the change rate of the refrigerant temperature.

2. The air-conditioning apparatus of claim 1, wherein the controller divides a value, which is obtained by subtracting a temperature of the refrigerant detected by the first temperature detection sensor at a predetermined time before from a current temperature of the refrigerant detected by the first temperature detection sensor, by a unit time to calculate the change rate of the refrigerant temperature, and if the change rate of the refrigerant temperature is zero or less, the controller causes the heating means to stop heating the compressor.

3. The air-conditioning apparatus of claim 1, wherein the controller calculates the change rate of the refrigerant temperature on the basis of a current refrigerant temperature and a refrigerant temperature at the predetermined time before which are detected by the first temperature detection sensor.

4. The air-conditioning apparatus of claim 1, wherein the controller estimates a refrigerant temperature after the predetermined time on the basis of at least a current refrigerant temperature and a refrigerant temperature at the predetermined time before which are detected by the first temperature detection sensor, and calculates the change rate of the refrigerant temperature on the basis of the refrigerant temperature after the predetermine time and the current refrigerant temperature.

5. The air-conditioning apparatus of claim 1, wherein the controller changes a heating capacity of the heating means so as to achieve the heating amount during a predetermined heating time.

6. The air-conditioning apparatus of claim 1, wherein the controller sets a heating capacity of the heating means to a predetermined value, and changes a length of a heating time so as to achieve the heating amount.

7. The air-conditioning apparatus of claim 1, further comprising:

a pressure detection sensor that detects a refrigerant pressure that is a pressure of the refrigerant in the refrigerant circuit;

wherein while the compressor is stopped, the controller reduces the heating amount of the heating means as the refrigerant pressure detected by the pressure detection sensor increases.

8. The air-conditioning apparatus of claim 1, further comprising:

a third temperature detection sensor that detects a temperature of air that exchanges heat with the refrigerant in the heat-source-side heat exchanger;

wherein the controller reduces the heating amount of the heating means as the temperature detected by the third temperature detection sensor increases.

9. The air-conditioning apparatus of claim 1, further comprising:

a draft detector that detects whether there is air passing through the heat-source-side heat exchanger;

wherein while the compressor is heated by the heating means, if the draft detector detects that there is the passing air, the controller increases the heating amount such that the heating amount becomes greater than that when there is no passing air.

10. The air-conditioning apparatus according to claim 1, wherein the heating means includes a motor unit and a compressor heater attached to the compressor.

11. An air-conditioning apparatus comprising:

a refrigerant circuit in which at least a compressor, a heat-source-side heat exchanger, expansion means, and a use-side heat exchanger are connected by a refrigerant pipe, and through which a refrigerant is circulated;

heating means that heats the compressor;

a pressure detection sensor that detects a refrigerant pressure that is a pressure of the refrigerant in the refrigerant circuit; and a controller that controls the heating means, wherein while the compressor is stopped, the controller converts the refrigerant pressure detected by the pressure detection sensor into a refrigerant saturation gas temperature, and calculates a change rate of the refrigerant saturation gas temperature per a time using the refrigerant saturation gas temperature and changes a heating amount to the compressor by the heating means to be proportional to the change rate of the refrigerant saturation gas temperature.

12. The air-conditioning apparatus according to claim 11, wherein the heating means includes a motor unit and a compressor heater attached to the compressor.

13. An air-conditioning apparatus comprising:

a refrigerant circuit in which at least a compressor, a heat-source-side heat exchanger, expansion means, and a use-side heat exchanger are connected by a refrigerant pipe, and through which a refrigerant is circulated;

heating means that heats the compressor;

a third temperature detection sensor that detects an outdoor temperature that is a temperature of air that exchanges heat with the refrigerant in the heat-source-side heat exchanger; and a controller that controls the heating means, wherein a heating capacity of the heat-source-side heat exchanger is greater than a heating capacity of the use-side heat exchanger, and while the compressor is stopped, the controller calculates a change rate of the outdoor temperature per a time using a detection value of the third temperature detection sensor and changes a heating amount to the compressor by the heating means to be proportional to the change rate of the outdoor temperature.

14. The air-conditioning apparatus according to claim 13, wherein the heating means includes a motor unit and a compressor heater attached to the compressor.

15. An air-conditioning apparatus comprising:

a refrigerant circuit in which at least a compressor, a heat-source-side heat exchanger, expansion means, and a use-side heat exchanger are connected by a refrigerant pipe, and through which a refrigerant is circulated;

heating means that heats the compressor;

a fourth temperature detection sensor that detects an indoor temperature that is a temperature of air that exchanges heat with the refrigerant in the use-side heat exchanger; and a controller that controls the heating means, wherein a heating capacity of the use-side heat exchanger is greater than a heating capacity of the heat-source-side heat exchanger, and while the compressor is stopped, the controller calculates a change rate of the indoor temperature per a time using a detection value of the fourth temperature detection sensor and changes a heating amount to the compressor by the heating means to be proportional to the change rate of the indoor temperature.

16. The air-conditioning apparatus according to claim 15, wherein the heating means includes a motor unit and a compressor heater attached to the compressor.

* * * * *